United States Patent [19]

Flannery

[11] Patent Number: 4,468,818

[45] Date of Patent: Sep. 4, 1984

[54] HEAD SCARF

[76] Inventor: Bobbie A. Flannery, 21 Plackmeier, St. Charles County, Mo. 63366

[21] Appl. No.: 494,946

[22] Filed: May 16, 1983

[51] Int. Cl.[3] ..... A42B 5/00

[52] U.S. Cl. ..... 2/207; 2/173; 2/195; 2/196; 2/204; 2/209.1; 2/274; D2/358

[58] Field of Search ..... 2/204, 207, 209.1, 173, 2/196, 274, 195, 195.3; D2/358, 248, 242, 239, 240, 241

[56] References Cited

U.S. PATENT DOCUMENTS

| | | | |
|---|---|---|---|
| 162,965 | 4/1951 | Krieger | 2/195 |
| 258,323 | 2/1981 | Lewis | D2/248 |
| 2,089,995 | 11/1936 | Dobbs | 2/195 |
| 2,112,774 | 1/1938 | Thorman | 2/207 |
| 2,199,427 | 5/1940 | Dohen | D2/242 X |
| 2,574,208 | 11/1951 | Crowthers | 2/207 |
| 2,735,109 | 7/1952 | Feldman | 2/195 |
| 2,832,961 | 5/1958 | Weiss | 2/195 |
| 2,948,900 | 12/1956 | Ebenstein | 2/209.1 |
| 3,376,581 | 8/1967 | Gettinger | 2/209.1 |

OTHER PUBLICATIONS

*McCalls*, "Hairdo Hats", p. 8, May 1954.

*Primary Examiner*—Werner H. Schroeder
*Assistant Examiner*—Mary A. Ellis
*Attorney, Agent, or Firm*—Gravely, Lieder & Woodruff

[57] ABSTRACT

A head scarf construction embodying the cooperation of a ply of fabric in a triangulated shape and a stiffened triangulated component connected in positions to bring the base margins of the triangles into alignment, the addition of surface decorations for the triangulated shapes to develop simulations of birds or animals, and tie elements for securing the scarf to the wearer's head.

9 Claims, 28 Drawing Figures

HEAD SCARF

BACKGROUND OF THE INVENTION

1. Field of the Invention

This invention is directed to head scarfs and more particularly to a head scarf that is capable of assuming a variety of designs representative of groups, teams and like organizations.

2. Description of the Prior Art

It is well known that head scarfs are worn mainly by women for various reasons, and that the scarfs have taken many forms, both in relation to the type of fabric and in the appearances the scarf is intended to convey. There are many different forms so that each has its own unique characteristic.

BRIEF DESCRIPTION OF THE PRESENT INVENTION

The head scarf of this invention is designed to present variations in the appearance desired and to accomplish that objective with one basic structural make up. The objective is attained in a unique arrangement of cooperating components which are constructed so as to be capable of assuming different appearances for the head scarf.

A presently preferred embodiment for a head scarf comprises large area and a small area triangular members so sized as to furnish a head covering by the large area member, and a bill or nose projection furnished by the small area member, and tie means connected to one or both members with loose ends of sufficient free length to provide securing the scarf by tying behind the wearer's head with the small area member projecting forwardly of and above the forehead to complete the desired appearance.

BRIEF DESCRIPTION OF THE DRAWINGS

The present embodiment of the invention has been illustrated in several variations which follow a basic arrangement of members, wherein.

DETAILED DESCRIPTION OF THE EMBODIMENTS

Figure 1:
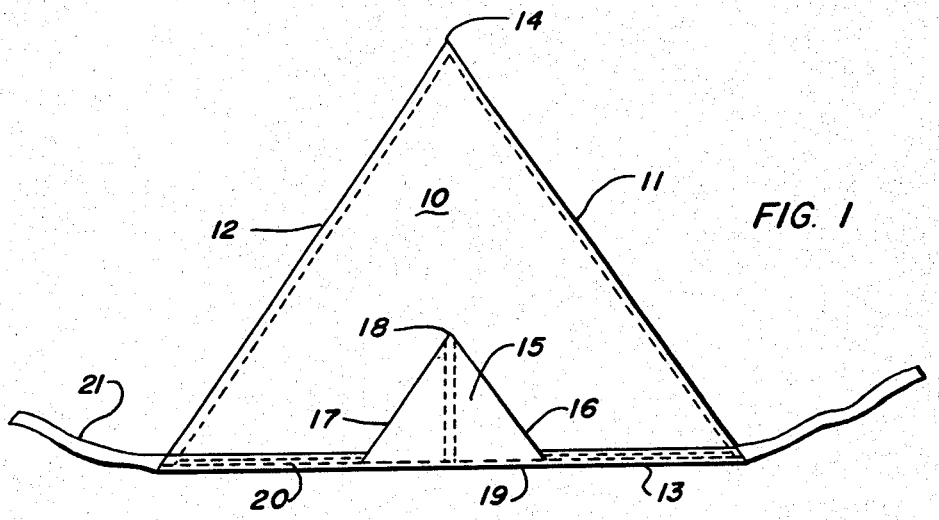
FIG. 1 is a plan view of the general arrangement of the several members making up the head scarf.

Referring now to FIG. 1, the head scarf is illustrated in plan view and is composed of a body portion 10 formed of a ply of flexible material such as a suitable fabric to provide in a flat layout a triangular area which is defined by three margins 11, 12 and 13, in which the margin 13 is a principal margin while the other margins 11 and 12 converge to meet at an apex 14 which is substantially centered to the mid point of the principal margin 13. Thus, the body portion 10 generally forms an isosceles triangle, although the body portion 10 may have other triangular forms. There is a second portion 15 also providing a generally triangular area defined by margins 16 and 17 which converge to an apex 18 opposite an elongated margin 19. The portion 15 is laid upon the body portion 10 so that its elongated margin 19 lies along the principal margin 13 and wherein the apex 18 is located so as to be in alignment with the apex 14 of body portion 10. The thus positioned portions 10 and 15 are secured by stitching in overlying flat relation by means of an elongated tubular tie 20 which is stitched simultaneously to the portions 10 and 15 and also extends outwardly at each side to provide free ends 21 for the purpose of securing the head scarf by a suitable knot or tie at the back of the head of a wearer.

Figure 2A:
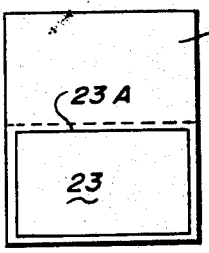
FIG. 2A is a plan view of the smaller triangular member laid out in an initial position.
Figure 2B:
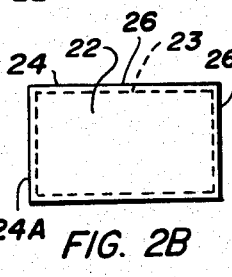
FIG. 2B is a plan view of the first fold imparted to the member of FIG. 2A.
Figure 2C:
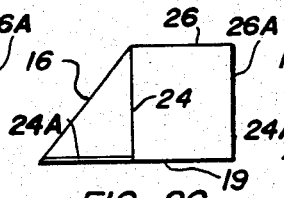
FIG. 2C is a plan view of the second fold imparted to the member of FIG. 2A.
Figure 2D:
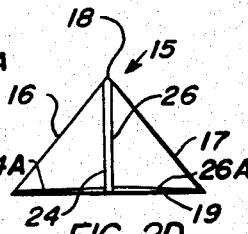
FIG. 2D is a plan view of the final fold imparted to the member of FIG. 2A resulting in its triangular shape.

Referring now to FIGS. 2A through 2D, there is disclosed the manner of constructing the portion 15 which is initially made up of a ply of suitable fabric or pliable material in the form of a square 22. In order to render the final formation of the portion 15 reasonably stiff and self-supporting, a ply of buckram or other suitable stiffening material 23 is laid upon substantially half of the initial square 22, all as shown in FIG. 2A. The margin 23A of the ply 23 establishes a fold line so that the upper portion of the square 22 can be folded downwardly over the buckram ply 23 to assume the position as seen in FIG. 2B. The next operation is shown in FIG. 2C where the upper left corner of the folded plies is folded down so as to form a diagonal margin 16 and so that the edge or margin 24 is moved to approximately the center of the length of the ply 22. There then follows the next folding operation in which the upper right corner is folded so as to create a diagonal margin 17 thereby completing the triangulation of the square 22 in which a second edge or margin 26 is spaced from the previously described edge margin 24. Now when the part shown in FIG. 2D is laid upon the triangular portion 10 of FIG. 1 the spaced meeting edges 24 and 26 are placed to lie upon the surface of the portion 10 and the smooth or unbroken surface of the portion 15 is uppermost.

The construction shows in FIGS. 2A to 2D has been described above and the intent thereof is to define the construction of the second portion 15 of the complete head scarf seen in FIG. 1. While the foregoing description is believed sufficient it may be better understood by referring to the rectangular fabric body 22 being folded as shown to turn in the left margin 24A to fall in registry with the straight margin 19 to create the folded margin 16. By doing the same with margin 26A that will create the folded margin 17 when the margin 26A registers with the straight margin 19. In folding the body 22 in this manner the triangular body 15 has a smooth uninterrupted side and an opposite side made up of the two folded portions which have adjacent free folded edges 24 and 26 directed substantially perpendicularly to the straight margin 19. The uniqueness of the way the body 22 is folded resides in the formation of a pocket under the folded portions with an entrance formed between the free folded edges 24 and 26. When the finally folded part of FIG. 2D is stitched to the principal body 10 in the manner described above, the margins 19, 24A and 26A are secured in the tubular tie 20. The triangular body 15 can be stiffened by laying in a piece of buckram or similar stiffening material.

Figure 3:
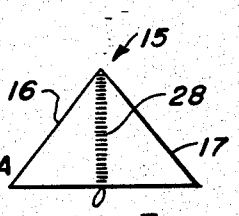
FIG. 3 is a view of the member of FIG. 2D when modified by the addition of a zipper closure connected to the adjacent margins of the folded portion.
Figure 4:
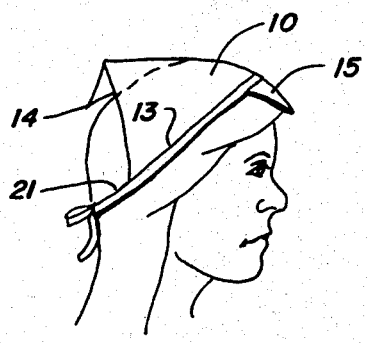
FIG. 4 is a side elevational view of the head scarf shown in its appearance when worn.
Figure 4A:
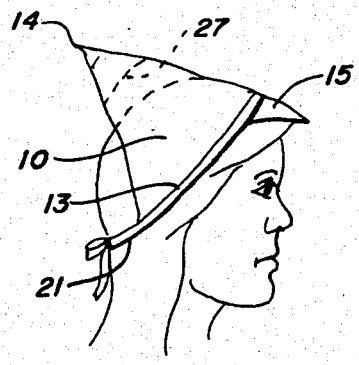
FIG. 4A is a view similar to FIG. 4 in which a line of stitching has changed the appearance.

The construction of the portion 15, as shown in FIG. 2D, may be modified (FIG. 3) as desired by the addition of a zipper closure 28 attached to the spaced meeting edges or margins 24 and 26 so as to form a closure for a pocket space under the folds which naturally result from the folding operation described in FIGS. 2C and 2D. As noted in FIG. 1, the body 15 is laid up on the body 10 with the edges 24 and 26 underneath. After stitching the body 15 is rotated out and forwarded as seen in FIGS. 4 and 4A which twists the tie 20 and causes that twist to exert a force to hold the body 15 from dropping down or going limp while the head scarf is worn. The twist imparted to the tie 20 is what causes the body 15 to be self-supporting. This effect is later referred to in connection with the construction of FIG. 7.

Looking now at FIG. 4 there is shown a side elevation of the head scarf in its position on the head of a wearer so as to reveal the appearance which is provided when the scarf is worn. It now appears that the triangular body portion 10 constitutes the principal head covering while the portion 15 projects forwardly of the margin 13 for the purpose of simulating the appearance of a bird's beak or possibly the nose of an animal. In the position on the head of a wearer the apex 14 and contiguous portions have the tendency to drape down over the hair, and the free ends 21 can be caused to meet at the back of the head where they can be brought into a securing knot or bowtie so as to hold the scarf in position.

FIG. 4A is very similar to FIG. 4 but shows a modification in which a line of stitching 27 has been applied at the position shown in the triangular body portion 10 so as to create a certain amount of stiffness in the peak of the body portion 10 so that a crest effect is achieved.

Figure 5:
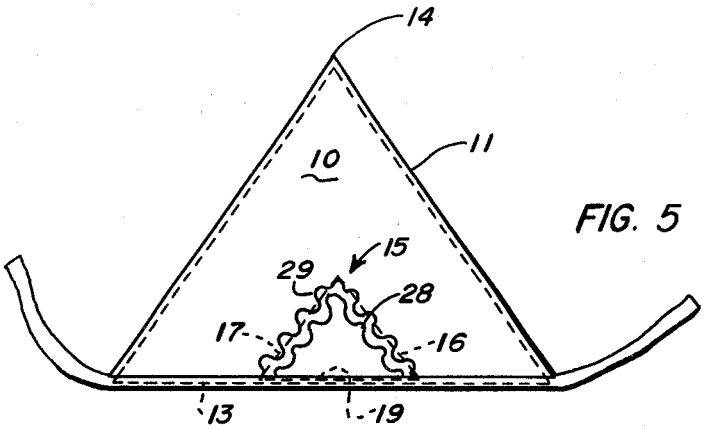
FIGS. 5 and 5A are each a plan view of the head scarf in which the addition of rick-rack changes the appearance.
Figure 5A:
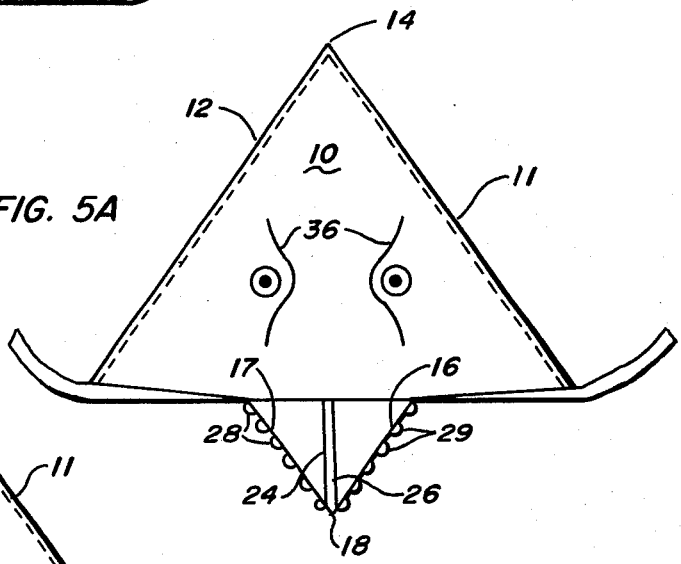

In FIG. 5 there is illustrated a modification differing from the view of FIG. 1 in that the portion 15 carries the addition of a strip of rick-rack 28 which is placed so that portions 29 of the rick-rack will extend beyond the folded margins 16 and 17 for the purpose illustrated in FIG. 5A of simulating the appearance of teeth that would be exposed when the portion 15 is rotated or folded out to expose the margins 24 and 26 and thereby simulate the nose and mouth of an animal.

Figure 6:
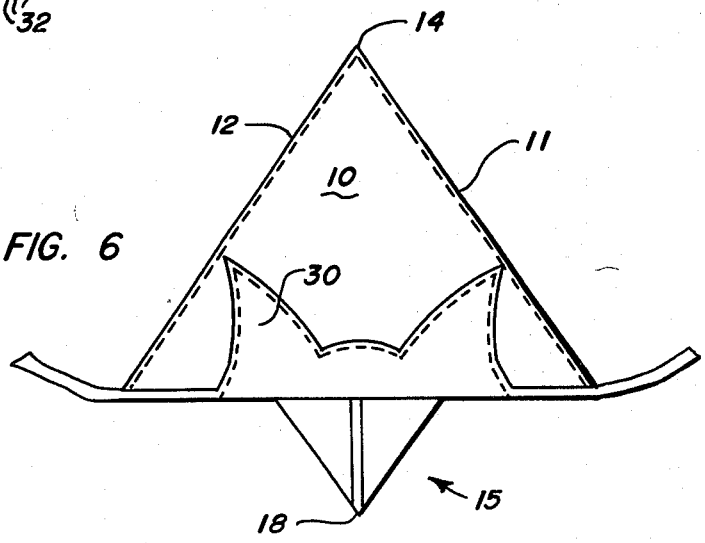
FIG. 6 is a view similar to FIG. 1 but modified by the addition of an applique to cooperate with the triangular members in presenting a different appearance.

Turning now to the view of FIG. 6 there is shown the modification of the head scarf in which the body portion 10 has been modified by the addition of an applique patch 30 lying along the margin 19 of the main body portion 10 and in substantially symmetrical relation to the triangular portion 15. When the head scarf of FIG. 6 is worn the applique 30 in combination with the triangular portion 15 is intended to simulate an animal such as a fox.

Figure 7:
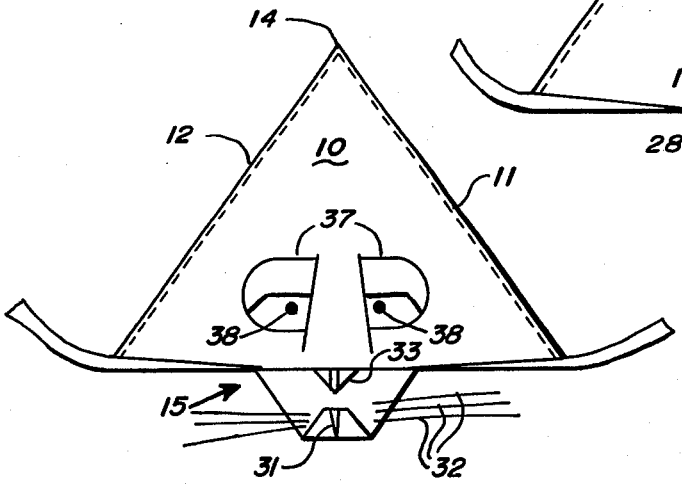
FIG. 7 is a plan view of the head scarf in which the addition of further members can alter the appearance.

In FIG. 7 the portion 15 which cooperates with portion 10 has been illustrated to show a modification in which the apex 18 had been folded back on the area of the portion 15 and is stitched into position through the space formed between the margins 24 and 26. The stitching illustrated at 31 is intended to secure elongated strips 32 in position so as to constitute whiskers on the variety of animals that are characterized by the presence of whiskers such as cats or tigers. There is also shown in FIG. 7 the addition of a greatly reduced sized triangular portion 33 which is constructed in accordance with the folding procedure illustrated in FIG. 2A through 2D. The portion 33 is secured simultaneously with the portion 15 in the margin 13 of the body portion 10 which is shown only fragmentarily. In stitching the assembly shown in FIG. 7 onto the body portion 10, that assembly of portion 15 is folded over upon the surface of the body portion 10 to enable the simultaneous stitching of the tie 20 so as to catch the aligned margins of the portions 33 and 15. Thereafter, the portion 15 can be folded out so as to expose the whiskers and the triangular portion 33. In order to complete the appearance effect desired for the construction shown in FIG. 7 the portions 15 and 33 may be formed of fabric or flexible material of contrasting colors, and the elongated elements 32 may also be formed of material of contrasting colors.

Figure 8:
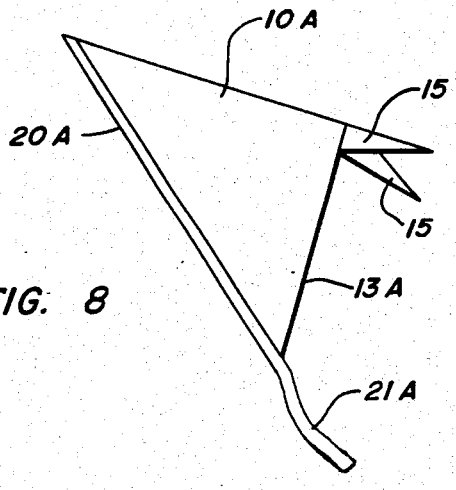
FIG. 8 is a side elevational view of a head scarf showing a further modification in which a pair of triangular members are joined to present a different appearance.

Turning now to FIG. 8 there is shown in side elevational view a head scarf which has been further modified to incorporate a pair of overlying triangular portions 15 which have been joined to a two-ply body portion 15A by means of a blind stitching technique along the margin 13A. In view of the reliance on blind stitching on the margin 13A, the provision of a tie for the scarf is modified so that an elongated tie 20A is stitched along the triangulated margins leaving opposite free ends 21A to secure the scarf when worn.

In keeping with the characterization of the head scarf to render its appearance in the form of a bird or an animal or some similar object, there is shown in the drawings in FIGS. 5 and 5A not only the addition of rick-rack 28 to the extension portion 15, but the surface of portion 10 is embellished with surface decoration in the form of painted-on eyes 35 and an outline of a nose represented by a pair of curved lines 36. It is also evident in FIGS. 5 and 5A that after the portion 15 has been assembled to the larger portion 10, the portion 15 must then be rotated about the stitch line in the margin 13 so as to expose the surface that is characterized by margins 24 and 26. A further surface treatment is shown in FIG. 6 where the applique 30 is stitched into position on the portion 10 to represent ears that would be complimentary to the projecting portion 15. FIG. 7, which has been described above, may be embellished by painted-on areas 37 which surround the placement of eyes 38 for the purpose of depicting a cat or a tiger. The disclosure in FIG. 8 is characterized by a pair of projections 15 which are connected to the portion 10A in a blind stitch seam 13A which is necessary in order to be able to have the head scarf assembly reversible so that a smooth appearance along seam 13A is achieved regardless of which side is outermost. In order to accomplish this appearance, it is necessary to make use of two-plies for the portion 10A, and because of the blind stitch seam 13A the tie is stitched to the triangular sides at 20A, leaving free ends 21A for the purpose of tying the head scarf at the back of the head of the wearer.

Figure 9:
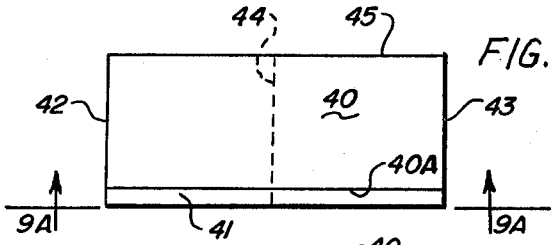
FIG. 9 is a modification of the smaller triangular member showing its components in an initial plan view.
Figure 9A:
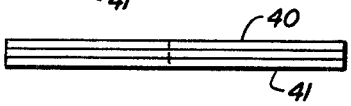
FIGS. 9A to 9F illustrate how the components are progressively treated to result in the formation of a triangular member, as in FIG. 9F.
Figure 9B:
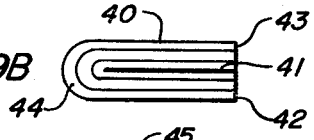
Figure 9C:
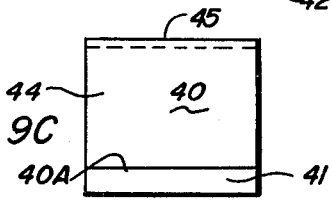
Figure 9D:
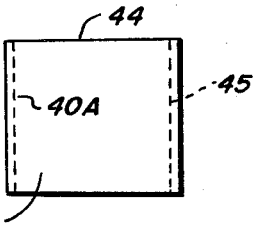
Figure 9E:
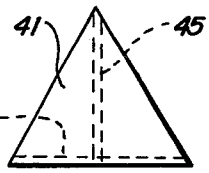

There is disclosed in FIGS. 9 and 9A a modified construction for the portion 15 which assumes a triangular form after starting from a rectangular flat ply of fabric 41 which is overlaid by a generally rectangular ply of buckram 40 for stiffening purposes. The two-plies 40 and 41 are folded along line 44 so the buckram is on the outside of the fabric 41 as in FIG. 9B. The folded plies of FIG. 9B are then stitched along the margin 45 so that the resulting square has a folded margin 44, the stitched margin 45, and a small area of the fabric 41 exposed at buckram margin 40A. Thereafter the construction of FIG. 9C must be turned inside out as in FIG. 9D where the folded margin 44 is at the top, the stitched margin 45 is at the right, and the fabric 41 covers the margin 40A of the now enclosed buckram. The next step is to convert the square of FIG. 9D into an isosceles triangle as in FIG. 9E. This step is performed by allowing the stitched margin 45 to rotate on itself while pushing the folded margin 44 to align over the stitched margin which is accomplished by allowing the fold to unfold so the triangular surface of the fabric 41 is on top and when the triangular form is turned over as in FIG. 9F, the stitched seam 45 appears on top. The now formed construction of FIGS. 9E or 9F is ready to be attached to the larger portion 10 to complete a head scarf, as described above.

Figure 9F:
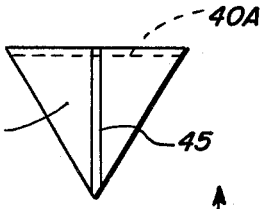

From the foregoing description relating to FIGS. 9 through 9F, it should be understood that the nose portion of the head scarf is constructed from a triangular ply of fabric and a cooperating ply of stiffening material folding into a substantially triangular shape and stitched along the margin at right angles to the fold margins so that two adjacent right angular margins are open and the other two are closed, whereby the folded and stitched square shape can be refolded into a triangular shape by bringing the folded margin into alignment with the stitched margin for forming the base margin of the triangle so it can be joined to the principal margin of the body portion.

Figure 10:
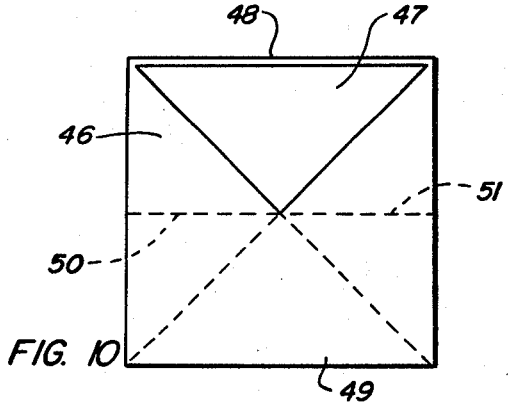
FIGS. 10 to 10B illustrate another modification of the smaller triangular member resulting in a variance from the double member seen in FIG. 8.
Figure 10A:
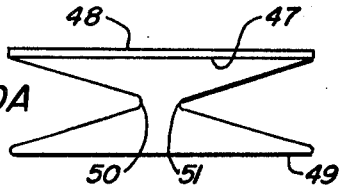
Figure 10B:
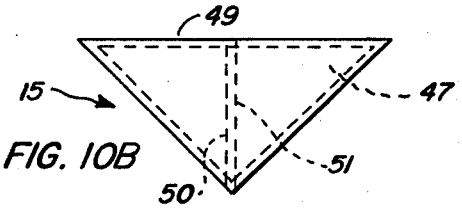

Another construction which the portion 15 may possess is shown in FIGS. 10 to 10B. In this form a square piece of fabric 46 is laid out in the flat, and a triangular ply of buckram 47 is placed on top so its base margin coincides with margin 48. The fabric 46 is indicated as having fold lines 50 and 51 which bisect the square, and other fold lines which are directed on the diagonals which coincide with the side margins of the buckram 47. The folding operation is illustrated in FIG. 10A which is to lift the fold lines 50 and 51 and push them into adjacent positions in inwardly folded positions while the fabric is folded on the diagonals so that the diagonals below the fold lines 50 and 51 move into alignment with the diagonals above the fold lines 50 and 51, thereby securely infolding the triangular ply of buckram 47. The result of this folding operation is the formation of the triangular portion 15.

It is to be understood from the construction described in FIGS. 10 and 10B inclusive that the modified nose portion includes a square ply of fabric to be folded along diagonal fold lines which cross substantially at the center of the square shape so that on additionally folding the square shape along two fold lines originating from opposite long sides of the square and intersecting the center crossing of the diagonal fold lines it is possible to establish a folded configuration as seen in FIG. 10A in which the two intersecting fold lines bring the diagonal fold lines inwardly to transform the square shape of the fabric ply into a triangular shape in which the triangular surfaces of the fabric are free of any interruptions. In a fold of this nature a stiffening ply of a triangular configuration may be inserted behind one of the triangular fabric surfaces so as to stiffen the resulting assembly.

Figure 11:
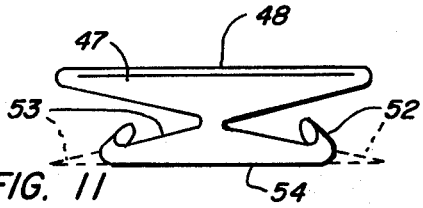
FIGS. 11 and 11A illustrate a modification of the folding steps to alter the appearance gained from the folding step taken in FIG. 10A.
Figure 11A:
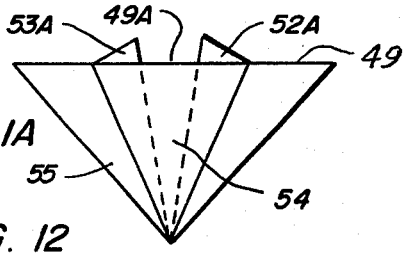

A variation in the construction which results in the portion 15 of FIG. 10B is shown in FIGS. 11 and 11A. Comparing FIG. 11 with FIG. 10A it is evident that the folds 52 and 53 shown in broken outline are now doubled inwardly to the full line positions. This reduces the exposed surface 54 to a smaller isosceles triangle than the underlying triangle 55. In making the doubled back fold 52 and 53, some of the material will project beyond margin 49, and that must be trimmed away.

The construction variation described in relation to FIGS. 11 and 11A follows the foregoing described folding procedure for the construction shown in FIGS. 10 through 10B. As shown in FIG. 11A the folds 52 and 53 reduce the exposed surface 54 of the fabric ply to a smaller isosceles triangle in which the base margin 49A is shorter than the base margin 49 for the opposite triangular ply. In making the additional folds 52 and 53 there will appear surplus material at 52, 52A, 53 and 53A which must be trimmed off before the assembly can be stitched into the body portion as shown in FIG. 1.

Figure 12:
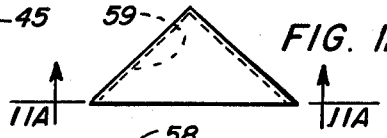
FIGS. 12 to 12B illustrate a further modification in respect of the smaller triangular members.
Figure 12A:
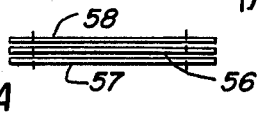
Figure 12B:
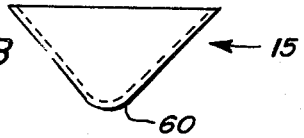

A further variation for the portion 15 is shown in FIGS. 12 to 12B. In this construction, two triangular fabric plies 56 and 57 (FIG. 12A) are mated with a triangular ply of buckram 58 and are secured together by a line of stitching 59 as in FIG. 12. This three ply construction must then be turned inside out so the buckram ply 58 is on the inside and the fabric plies are on the outside. This form for portion 15 can be given a rounded apex 60 when inverted as the stitching 59 can be rounded at the apex seen in FIG. 12.

In view of the foregoing disclosure of the basic structural configuration and of the surface treatment that may be applied to that basic structure, it should be apparent that other variations will come to mind without departing from the objectives of the present invention which is to provide a combination head scarf and sport head covering.

What is claimed is:

1. A head scarf designed to represent a predetermined object, said scarf comprising:

(a) a body portion of a fabric ply in the shape of a triangulated area defined by three margins, one of which is a principal margin and the other two margins angularly converge to meet at a principal apex which is substantially centered to a mid-point of the principal margin;

(b) a nose portion of a fabric ply rectangular in shape in initial flat plan, said rectangularly shaped fabric ply having portions folded inwardly upon itself to form a triangulated area defined by two folded margins angularly converging to meet at an apex and a third elongated margin; said inwardly folded portions having adjacent edges substantially aligned with said principal apex and other margins lying in substantial registry with said elongated margin;

(c) tie means extending along said principal margin of said body portion and having opposite free ends extending beyond said principal margin, whereby said free ends may be tied at the back of the head; and (d) means fixing said tie means, said nose portion elongated margin and said other margins lying in registry with said elongated margin to said principal margin of said body portion with said nose portion overlying said body portion, said nose portion being free to be rotated about said principal margin to an extended position relative to said body portions.

2. The head scarf set forth in claim 1 wherein said inwardly folded portions present a triangulated area having an interrupted surface and an opposite uninterrupted surface, said adjacent edges of said inwardly folded portions being free to provide an access opening beneath said inwardly folded portions.

3. The head scarf set forth in claim 1 wherein said nose portion is initially fixed to said body portion with its inwardly folded portions presented to said body portion, and rick-rack is connected to each of said two folded margins of said nose portion for simulating teeth with said nose portion rotated out so as to extend from the principal margin of said body portion.

4. The head scarf set forth in claim 1 wherein said body and nose portions are positioned with said principal margin and said third elongated margin in overlying registration and with said apex of said nose portion in substantial alignment with said apex of said body portion.

5. A combined head scarf and sport head covering comprising:

(a) a body portion of a fabric material to form a head covering, said material having a triangular shape in flat plan, one edge thereof constituting a principal margin of the body portion which is substantially straight;

(b) a second body portion of a fabric material foldable into a triangular shape in flat plan, one margin thereof being substantially straight and serving as a base margin of said second body, said second body portion having certain portions of the fabric material folded onto other portions of the fabric material, said certain folded portions having a pair of edges in spaced adjacency and directed to align substantially perpendicularly to said one substantially straight margin;

(c) tie means extending along said principal margin and said one substantially straight margin, said tie means having oppositely extending free ends; and (d) means connecting said tie means to both of said principal and one straight margins for initially positioning said second body portion with said pair of spaced edges facing said body portion, said connecting means establishing a fold line for rotating said second body portion into position exposing said pair of spaced edges.

6. The combined head scarf and sport head covering set forth in claim 5 wherein said second body portion is constructed initially of a square ply of fabric characterized by said one substantially straight margin, diagonal fold lines crossing centrally of the square shape and two fold lines intersecting the central crossing of the diagonal fold lines and extending substantially parallel to said one substantially straight margin with said two fold lines folded into adjacent positions and said diagonal fold lines folded into overlying adjacency at substantially 45° to said two folded lines.

7. The combined head scarf and sport head covering set forth in claim 5 wherein a ply of stiffening material of triangular shape is inserted into said second body portion of fabric material.

8. The combined head scarf and sport head covering set forth in claim 5 wherein said second body portion of fabric foldable into a triangular shape is further characterized by a plurality of folds whereby one exposed surface of the fabric is an isosceles triangle having said base margin and the opposite exposed surface is also an isosceles triangle having a base margin different from said first mentioned base margin.

9. The combined head scarf and sport head covering set forth in claim 5 wherein a preshaped ply of fabric is secured to said first mentioned body portion adjacent said principal margin, said preshaped ply being sized to cooperate with said second body portion to respresent a predetermined character.

* * * * *